US009193209B2

(12) United States Patent
Dooley et al.

(10) Patent No.: US 9,193,209 B2
(45) Date of Patent: Nov. 24, 2015

(54) INFRARED REFLECTIVE PIGMENTS IN A TRANSFIX BLANKET IN A PRINTER

(71) Applicant: XEROX CORPORATION, Norwalk, CT (US)

(72) Inventors: Brynn Dooley, Toronto (CA); Marcel Philippe Breton, Mississauga (CA); Gordon Sisler, St. Catharines (CA); Santokh S. Badesha, Pittsford, NY (US); David J. Gervasi, Pittsford, NY (US); Mandakini Kanungo, Penfield, NY (US)

(73) Assignee: XEROX CORPORATION, Norwalk, CT (US)

( * ) Notice: Subject to any disclaimer, the term of this patent is extended or adjusted under 35 U.S.C. 154(b) by 35 days.

(21) Appl. No.: 14/180,829

(22) Filed: Feb. 14, 2014

(65) Prior Publication Data

US 2015/0231910 A1 Aug. 20, 2015

(51) Int. Cl.

| | |
|---|---|
| ***B41J 2/01*** | (2006.01) |
| ***B41N 10/02*** | (2006.01) |
| ***B41J 2/005*** | (2006.01) |

(52) U.S. Cl.

CPC ..... *B41N 10/02* (2013.01); *B41J 2/0057* (2013.01)

(58) Field of Classification Search

CPC ..... B41N 10/02; B41J 2/0057
USPC ..... 347/103
See application file for complete search history.

(56) References Cited

U.S. PATENT DOCUMENTS

| | | | | |
|---|---|---|---|---|
| 7,608,325 | B2 | 10/2009 | Rasch et al. | |
| 8,247,066 | B2 | 8/2012 | Wu | |
| 2002/0064648 | A1 * | 5/2002 | Schlueter et al. | 428/332 |
| 2003/0233952 | A1 * | 12/2003 | Pan et al. | 101/217 |
| 2012/0103212 | A1 | 5/2012 | Stowe et al. | |
| 2012/0301818 | A1 | 11/2012 | Gilmartin et al. | |
| 2014/0060352 | A1 | 3/2014 | Gervasi et al. | |
| 2014/0060357 | A1 | 3/2014 | Hsieh | |
| 2014/0060359 | A1 | 3/2014 | Kanungo et al. | |
| 2014/0060360 | A1 | 3/2014 | Moorlag et al. | |
| 2014/0060361 | A1 | 3/2014 | Gervasi et al. | |
| 2014/0060363 | A1 | 3/2014 | Kelly et al. | |

OTHER PUBLICATIONS

Mandakini Kanungo et al., "Fluoroelastomers for Marking System Component, Including Grafted Fluorinated Polymers", U.S. Appl. No. 13/931,983, filed Jun. 30, 2013.
Varun Sambhy et al., "Indirect Printing Apparatus Employing Sacrificial Coating on Intermediate Transfer Member", U.S. Appl. No. 14/105,498, filed Dec. 13, 2013.
Brynn Dooley et al., "Transfix Surface Member Coating", U.S. Appl. No. 14/219,481, filed Mar. 19, 2014.

(Continued)

*Primary Examiner* — Stephen Meier
*Assistant Examiner* — Alexander D Shenderov
(74) *Attorney, Agent, or Firm* — MH2 Technology Law Group LLP

(57) ABSTRACT

A transfix blanket for a printer may include a substrate layer. A conformance layer may be disposed at least partially on the substrate layer. An adhesive layer may be disposed at least partially on the conformance layer. At least one of the conformance layer and the adhesive layer may include a plurality of infrared reflective pigments. A topcoat layer may be disposed at least partially on the adhesive layer. The topcoat may include an infrared absorptive material.

20 Claims, 3 Drawing Sheets

(56) References Cited

OTHER PUBLICATIONS

Anthony S. Condello et al., "Transfix Surface Member Coating", U.S. Appl. No. 14/250,482, filed Apr. 11, 2014.
Kanungo et al., "Methods for Forming Functionalized Carbon Black with Amino-Terminated Polyfluorodimethylsiloxane for Printing", U.S. Appl. No. 14/041,508, filed Sep. 30, 2013.
Author Unknown, "Chemical reactions on the "finished" silicone", Silicones Europe, http://www.silicones.eu/science-research/chemistry/chemical-reactions-on-the-finished-silicone, accessed Dec. 13, 2014, pp. 1-4.
Chen et al, "A New Imaging Plate Coating Composite Composed of Fluoroelastomer and Aminosilane Crosslinkers", U.S. Appl. No. 14/229,350, filed Mar. 28, 2014.
Dooley et al., "Infrared Reflective Pigments in a Transfix Blanket in a Printer", U.S. Appl. No. 14/180,829, filed Feb. 14, 2014.
Gervasi et al., "Grafted Polymers as Oleophobic or Hydrophobic Coatings", U.S. Appl. No. 14/161,178, filed Jan. 22, 2014.

* cited by examiner

INFRARED REFLECTIVE PIGMENTS IN A TRANSFIX BLANKET IN A PRINTER

TECHNICAL FIELD

The present teachings relate to printers and, more particularly, to a transfix blanket in a printer.

BACKGROUND

In indirect aqueous printing, an aqueous ink is jetted onto an intermediate imaging surface, typically called a blanket, and the ink is partially dried on the blanket prior to transfixing the image to a media substrate, such as a sheet of paper. As it is important not to disturb the semi-wet ink, non-contact heating is employed to dry the ink. The non-contact heating may be radiant or convection heating; however, convection heating may be impractical due to size, cost, and noise.

Radiant heat, while fast acting and effective, is not color blind. It has been observed that for a given radiant source wavelength, different colors of ink exhibit different degrees of photothermal conversion. For example, black ink ("K") absorbs heat and dries more quickly than cyan ("C"), magenta ("M"), and/or yellow ("Y"). A system and method that mitigates these differences, thereby enabling ink to dry more efficiently would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

A transfix blanket for a printer is disclosed. The transfix blanket may include a substrate layer. A conformance layer may be disposed at least partially on the substrate layer. An adhesive layer may be disposed at least partially on the conformance layer. At least one of the conformance layer and the adhesive layer may include a plurality of infrared reflective pigments. A topcoat layer may be disposed at least partially on the adhesive layer. The topcoat may include an infrared absorptive material.

In another embodiment, the transfix blanket may include a substrate layer. A conformance layer may be disposed at least partially on the substrate layer. An adhesive layer may be disposed at least partially on the conformance layer. A topcoat layer may be disposed at least partially on the adhesive layer. The topcoat layer may include a plurality of infrared reflective pigments and an infrared absorptive material.

A method for operating a printer is also disclosed. The method may include jetting ink onto a transfix blanket. The transfix blanket may include a substrate layer, a conformance layer, an adhesive layer, and a topcoat layer. The conformance layer may be disposed at least partially on the substrate layer. The adhesive layer may be disposed at least partially on the conformance layer. The topcoat layer may be disposed at least partially on the adhesive layer. The topcoat layer may include an infrared absorptive material. At least one of the conformance layer, the adhesive layer, and the topcoat layer may include a plurality of infrared reflective pigments. The ink may be heated on the aqueous transfix blanket.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the figures have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same, similar, or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc.

Figure 1:
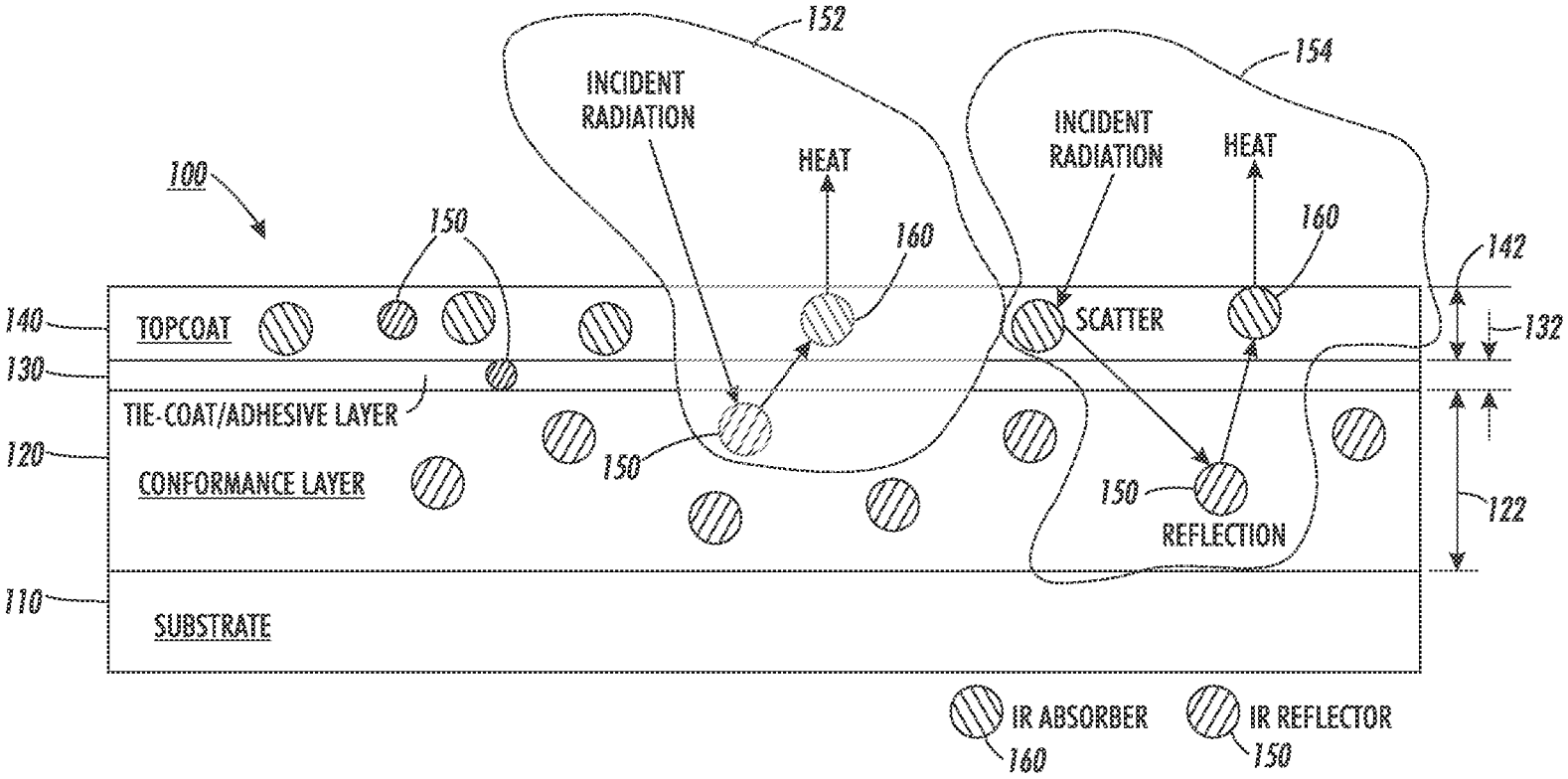
FIG. 1 depicts a schematic cross-sectional view of an illustrative transfix blanket for a printer, according to one or more embodiments disclosed.

It will be understood that the structures depicted in the figures may include additional features not depicted for simplicity, while depicted structures may be removed or modified. FIG. 1 depicts a schematic cross-sectional view of an illustrative transfix blanket 100 for a printer (e.g., an indirect aqueous inkjet printer), according to one or more embodiments disclosed. The blanket 100 may include a first or substrate layer 110. The substrate layer 110 may be made from or include polyimide, aluminum, woven fabric, or combinations thereof.

A second or conformance layer 120 may be disposed at least partially on and/or over the substrate layer 110. The conformance layer 120 may have a depth or thickness 122 ranging from about 500 μm to about 7000 μm, about 1000 μm to about 5000 μm, or about 2000 μm to about 4000 μm. The conformance layer 120 may be made from a composite material. More particularly, the conformance layer 120 may be made from or include a polymer matrix. The polymer matrix may be or include silicone, a cross-linked silane, or a combination thereof.

The conformance layer 120 may also include one or more filler materials such as silica, alumina, iron oxide, carbon black, or a combination thereof. The filler materials may be present in the conformance layer 120 in an amount ranging from about 0.1 wt % to about 20 wt %, about 1 wt % to about 15 wt %, or about 2 wt % to about 10 wt %.

The conformance layer 120 may further include one or more infrared ("IR") reflective pigments 150. The reflective pigments 150 may be or include titanium dioxide, nickel rutile, chromium rutile, cobalt-based spinel, chromium oxide, chrome iron nickel black spinel, or a combination thereof. The reflective pigments 150 may be present in the conformance layer 120 in an amount ranging from about 0.1 wt % to about 20 wt %, about 1 wt % to about 15 wt %, or about 2 wt % to about 10 wt %. The reflective pigments 150 may be or include particles having an average cross-sectional length (e.g., diameter) ranging from about 0.1 μm to about 10 μm, about 0.5 μm to about 8 μm, or about 1 μm to about 5 μm.

A third or tiecoat/adhesive layer 130 may be disposed at least partially on and/or over the conformance layer 120. The adhesive layer 130 may have a depth or thickness 132 ranging from about 0.05 μm to about 10 μm, about 0.25 μm to about 5 μm, or about 0.5 μm to about 2 μm. The adhesive layer 130 may be made from a silane, an epoxy silane, an amino silane adhesive, or a combination thereof. In another embodiment, the adhesive layer 130 may be made from a composite material. More particularly, the adhesive layer 130 may be made from or include a polymer matrix. The polymer matrix may be or include silicone, a cross-linked silane, or a combination thereof.

The adhesive layer 130 may further include one or more infrared reflective pigments 150. Thus, the conformance layer 120, the adhesive layer 130, or both may include the reflective pigments 150. The reflective pigments 150 in the adhesive layer 130 may be the same as the reflective pigments 150 in the conformance layer 120, or they may be different. For example, the reflective pigments 150 in the adhesive layer 130 may be or include titanium dioxide, nickel rutile, chromium rutile, cobalt-based spinel, chromium oxide, chrome iron nickel black spinel, or a combination thereof. The reflective pigments 150 may be present in the adhesive layer 130 in an amount ranging from about 0.1 wt % to about 20 wt %, about 1 wt % to about 15 wt %, or about 2 wt % to about 10 wt %.

The reflective pigments 150 in the conformance layer 120 and/or the adhesive layer 130 may reflect radiant energy that has passed through the topcoat layer 140 (discussed below) without being absorbed (i.e., "waste" radiant energy"). The reflection may occur in two similar yet different mechanisms, as illustrated in FIG. 1. In a first case 152, a portion of the incident radiant energy may pass through the topcoat layer 140 without being absorbed. When the reflective pigments 150 are present in the conformance layer 120 and/or the adhesive layer 130, a portion of the radiant energy may be reflected (off the reflective pigments 150) back into the topcoat layer 140 where the radiant energy may be absorbed by infrared absorbent materials 160 (described in more detail below).

In a second case 154, radiant energy that is scattered rather than absorbed by the topcoat layer 140 may be reflected off of the reflective pigments 150 in the conformance layer 120 and/or the adhesive layer 130 back into the topcoat layer 140 where the radiant energy may be absorbed by the infrared absorbent materials 160.

Thus, the incorporation of the reflective pigments 150 into the conformance layer 120 and/or the adhesive layer 130 of the aqueous transfix blanket 100 may enable reflection of transmitted or scattered "waste" radiant energy back into the topcoat layer 140 where the radiant energy may be absorbed. Once absorbed, the radiant energy may be converted to heat in the (carbon black-containing) topcoat layer 140. This may provide improved photothermal conversion and ultimately heating of the topcoat layer 140, which may result in more even ink drying. As a result, this may reduce the amount of radiant energy waste, and improve the efficiency of ink drying. The inclusion of the reflective pigments 150 in the conformance layer 120 and/or the adhesive layer 130 may also allow the drying process (e.g., Adphos lamps) to run at reduced power because the efficiency of photothermal conversion may be improved.

A fourth or topcoat layer 140 may be disposed at least partially on and/or over the adhesive layer 130. The topcoat layer 140 may have a depth or thickness 142 ranging from about 5 μm to about 100 μm, about 10 μm to about 75 μm, or about 25 μm to about 50 μm. The topcoat layer 140 may be made from a composite material. More particularly, the topcoat layer 140 may be made from or include a polymer matrix. The polymer matrix may be or include silicone, a cross-linked silane, a fluoroelastomer a fluoroplastic, or a combination thereof. The fluoroelastomer may be or include (a) one or more copolymers of vinylidene fluoride, hexafluoropropylene, and tetrafluoroethylene (b) one or more terpolymers of vinylidene fluoride, hexafluoropropylene, and tetrafluoroethylene, and/or (c) one or more tetrapolymers of vinylidene fluoride, hexafluoropropylene, tetrafluoroethylene, and (optionally) a cure site monomer.

The topcoat layer 140 may also include one or more infrared absorptive filler materials 160 such as carbon black, graphene, carbon nanotubes, iron oxide, or a combination thereof. The infrared absorptive filler materials may be present in the topcoat layer 140 in an amount ranging from about 0.1 wt % to about 20 wt %, about 1 wt % to about 15 wt %, or about 2 wt % to about 10 wt %.

The topcoat layer 140 may further include one or more infrared reflective pigments 150. Thus, the conformance layer 120, the adhesive layer 130, the topcoat layer 140, or a combination thereof may include the reflective pigments 150. The reflective pigments 150 in the topcoat layer 130 may be the same as the reflective pigments 150 in the conformance layer 120 and/or the adhesive layer 130, or they may be different. The reflective pigments 150 in the topcoat layer 140 may be or include titanium dioxide, nickel rutile, chromium rutile, cobalt-based spinel, chromium oxide, chrome iron nickel black spinel, or a combination thereof. The reflective pigments 150 may be present in the topcoat layer 140 in an amount ranging from about 0.1 wt % to about 20 wt %, about 1 wt % to about 15 wt %, or about 2 wt % to about 10 wt %.

The incorporation of the reflective pigments 150 into the topcoat layer 140 may improve the reflection of radiant energy back into the ink for absorption by the ink components for improved and/or enhanced ink drying. When the reflective pigments 150 are combined in the topcoat layer 140 with the absorptive materials 160 (e.g., carbon black), the efficiency of photothermal conversion may be enhanced (i.e., relative to carbon black alone). Further, the differential rate of drying among different ink colors may be reduced or eliminated. The amount of radiant energy waste may be reduced, and the efficiency of the ink drying may improve.

Figure 2:
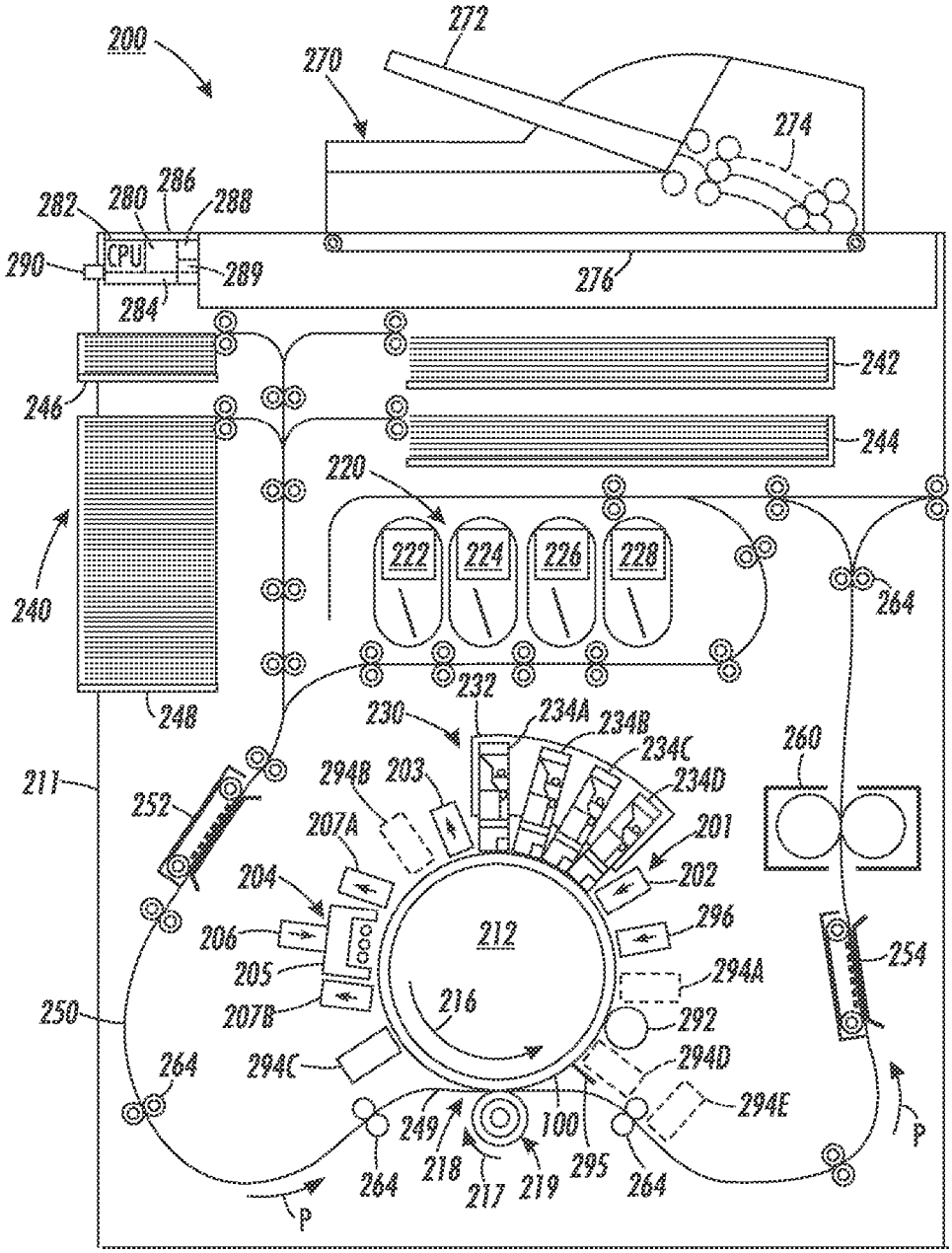
FIG. 2 depicts an illustrative printer including the transfix blanket, according to one or more embodiments disclosed.

FIG. 2 depicts an illustrative printer 200 including the transfix blanket 100, according to one or more embodiments disclosed. The printer 200 may be an indirect aqueous inkjet printer that forms an ink image on a surface of the blanket 100. The blanket 100 may be mounted about an intermediate rotating member 212. The ink image may be transferred from the blanket 100 to media passing through a nip 218 formed between the blanket 100 and a transfix roller 219.

A print cycle is now described with reference to the printer 200. A "print cycle" refers to operations of the printer 200 including, but not limited to, preparing an imaging surface for printing, ejecting ink onto the imaging surface, treating the ink on the imaging surface to stabilize and prepare the image for transfer to media, and transferring the image from the imaging surface to the media.

The printer 200 may include a frame 211 that supports operating subsystems and components, which are described below. The printer 200 may also include an intermediate transfer member, which is illustrated as a rotating imaging drum 212. The imaging drum 212 may have the blanket 100 mounted about the circumference of the drum 212. The blanket 100 may move in a direction 216 as the member 212 rotates. The transfix roller 219 may rotate in the direction 217 and be loaded against the surface of blanket 100 to form the transfix nip 18, within which ink images formed on the surface of blanket 100 are transfixed onto a print medium 249. In some embodiments, a heater in the drum 212 or in another location of the printer heats the blanket 100 to a temperature in a range of, for example, approximately 50° C. to approximately 70° C. The elevated temperature promotes partial drying of the liquid carrier that is used to deposit the hydrophilic composition and the water in the aqueous ink drops that are deposited on the blanket 100.

A surface maintenance unit ("SMU") 292 may remove residual ink left on the surface of the blanket 100 after the ink images are transferred to the print medium 249. The SMU 292 may include a coating applicator, such as a donor roller (not shown), which is partially submerged in a reservoir (not shown) that holds a hydrophilic polyurethane coating composition in a liquid carrier. The donor roller may rotate in response to the movement of the blanket 100 in the process direction. The donor roller may draw the liquid polyurethane composition from the reservoir and deposit a layer of the polyurethane composition on the blanket 100. As described below, the polyurethane composition may be deposited as a uniform layer having any desired thickness. After a drying process, the dried polyurethane coating may substantially cover a surface of the blanket 100 before the printer 200 ejects ink drops during a print process. The SMU 292 may be operatively connected to a controller 280, described in more detail below, to enable the controller 280 to operate the donor roller, as well as a metering blade and a cleaning blade to deposit and distribute the coating material onto the surface of the blanket 100 and to remove un-transferred ink and any polyurethane residue from the surface of the blanket 100.

The printer 200 may also include a dryer 296 that emits heat and optionally directs an air flow toward the polyurethane composition that is applied to the blanket 100. The dryer 296 may facilitate the evaporation of at least a portion of the liquid carrier from the polyurethane composition to leave a dried layer on the blanket 100 before the intermediate transfer member passes one or more printhead modules 234A-234D to receive the aqueous printed image.

The printer 200 may also include an optical sensor 294A, also known as an image-on-drum ("IOD") sensor, which is configured to detect light reflected from the blanket 100 and the polyurethane coating applied to the blanket 100 as the member 212 rotates past the sensor. The optical sensor 294A includes a linear array of individual optical detectors that are arranged in the cross-process direction across the blanket 100. The optical sensor 294A generates digital image data corresponding to light that is reflected from the blanket 100 and the polyurethane coating. The optical sensor 294A generates a series of rows of image data, which are referred to as "scanlines," as the intermediate transfer member 212 rotates the blanket 100 in the direction 216 past the optical sensor 294A. In at least one embodiment, each optical detector in the optical sensor 294A may include three sensing elements that are sensitive to wavelengths of light corresponding to red, green, and blue (RGB) reflected light colors. In another embodiment, the optical sensor 294A may include illumination sources that shine red, green, and blue light. In yet another embodiment, the sensor 294A may have an illumination source that shines white light onto the surface of blanket 100, and white light detectors are used.

The optical sensor 294A may shine complementary colors of light onto the image receiving surface to enable detection of different ink colors using the photodetectors. The image data generated by the optical sensor 294A may be analyzed by the controller 280 or other processor in the printer 200 to identify the thickness of the polyurethane coating on the blanket 100. The thickness and coverage may be identified from either specular or diffuse light reflection from the blanket 100 and/or the coating. Other optical sensors 294B, 294C, and 294D may be similarly configured and located in different locations around the blanket 100 to identify and evaluate other parameters in the printing process, such as missing or inoperative inkjets and ink image formation prior to image drying (294B), ink image treatment for image transfer (294C), and the efficiency of the ink image transfer (294D). Alternatively, some embodiments may include an optical sensor to generate additional data that may be used for evaluation of the image quality on the media (294E).

The printer 200 may include an airflow management system 201, which generates and controls a flow of air through the print zone. The airflow management system 201 may include a printhead air supply 202 and a printhead air return 203. The printhead air supply 202 and return 203 may be operatively connected to the controller 280 or some other processor in the printer 200 to enable the controller to manage the air flowing through the print zone. This regulation of the air flow may be through the print zone as a whole or about one or more printhead arrays. The regulation of the air flow may help to prevent evaporated solvents and water in the ink from condensing on the printhead and as well as attenuating heat in the print zone to reduce the likelihood that ink dries in the inkjets, which may clog the inkjets. The airflow management system 201 may also include one or more sensors to detect humidity and temperature in the print zone to enable more precise control of the temperature, flow, and humidity of the air supply 202 and return 203 to ensure optimum conditions within the print zone.

The printer 200 may also include an aqueous ink supply and delivery subsystem 220 that has at least one source 222 of one color of aqueous ink. Since the printer 200 is a multicolor image producing machine, the ink delivery system 220 includes, for example, four (4) sources 222, 224, 226, 228, representing four (4) different colors CYMK (cyan, yellow, magenta, black) of aqueous inks.

The printhead system 230 may include a printhead support 232, which provides support for a plurality of printhead modules, also known as print box units, 234A-234D. Each printhead module 234A-234D effectively extends across the width of the blanket 100 and ejects ink drops onto the blanket 100. A printhead module 234A-234D may include a single printhead or a plurality of printheads configured in a staggered arrangement. Each printhead module 234A-234D may be operatively connected to a frame (not shown) and aligned to eject the ink drops to form an ink image on the coating on the blanket 100. The printhead modules 234A-234D may include associated electronics, ink reservoirs, and ink conduits to supply ink to the one or more printheads. One or more conduits (not shown) may operatively connect the sources 222, 224, 226, and 228 to the printhead modules 234A-234D to provide a supply of ink to the one or more printheads in the modules 234A-234D. As is generally familiar, each of the one or more printheads in a printhead module 234A-234D may eject a single color of ink. In other embodiments, the printheads may be configured to eject two or more colors of ink. For example, printheads in modules 234A and 234B may eject cyan and magenta ink, while printheads in modules 234C and 234D may eject yellow and black ink. The printheads in the illustrated modules 234A-234D are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 200 includes four printhead modules 234A-234D, each of which has two arrays of printheads, alternative configurations include a different number of printhead modules or arrays within a module.

After the printed image on the blanket 100 exits the print zone, the image passes under an image dryer 204. The image dryer 204 may include a heater, such as a radiant infrared heater, a radiant near infrared heater, and/or a forced hot air convection heater 205. The image dryer 204 may also include a dryer 206, which is illustrated as a heated air source, and air returns 207A and 207B. The infrared heater 205 may apply infrared heat to the printed image on the surface of the blanket 100 to evaporate water or solvent in the ink. The heated air source 206 may direct heated air over the ink to supplement the evaporation of the water or solvent from the ink. In at least one embodiment, the dryer 206 may be a heated air source with the same design as the dryer 296. While the dryer 206 may be positioned along the process direction to dry the hydrophilic composition, the dryer 206 may also be positioned along the process direction after the printhead modules 234A-234D to at least partially dry the aqueous ink on the blanket 100. The air may then be collected and evacuated by air returns 207A and 207B to reduce the interference of the air flow with other components in the printing area.

The printer 200 may further include a print medium supply and handling system 240 that stores, for example, one or more stacks of paper print mediums of various sizes. The print medium supply and handling system 240, for example, includes sheet or substrate supply sources 242, 244, 246, and 248. The supply source 248 may be a high capacity paper supply or feeder for storing and supplying image receiving substrates in the form of cut print mediums 249. The print medium supply and handling system 240 may also include a substrate handling and transport system 250 that has a media pre-conditioner assembly 252 and a media post-conditioner assembly 254. The printer 200 may also include a fusing device 260 to apply additional heat and pressure to the print medium after the print medium passes through the transfix nip 218. The printer 200 may also include an original document feeder 270 that has a document holding tray 272, document sheet feeding and retrieval devices 274, and a document exposure and scanning system 276.

Operation and control of the various subsystems, components, and functions of the printer 200 may be performed with the aid of the controller 280. The controller 80 may be operably connected to the intermediate transfer member 212, the printhead modules 234A-234D (and thus the printheads), the substrate supply and handling system 240, the substrate handling and transport system 250, and, in some embodiments, the one or more optical sensors 294A-294E. The controller 280 may be a self-contained, dedicated mini-computer having a central processor unit ("CPU") 282 with electronic storage 284, and a display or user interface ("UI") 286. The controller 80 may include a sensor input and control circuit 288 as well as a pixel placement and control circuit 289. In addition, the CPU 282 may read, capture, prepare, and manage the image data flow between image input sources, such as the scanning system 276, or an online or a work station connection 290, and the printhead modules 234A-234D. As such, the controller 80 may be the main multi-tasking processor for operating and controlling all of the other machine subsystems and functions.

Once an image or images have been formed on the blanket 100 and coating under control of the controller 280, the printer 200 may operate components within the printer 200 to perform a process for transferring and fixing the image or images from the blanket 100 to media. The controller 280 may operate actuators to drive one or more of the rollers 264 in the media transport system 250 to move the print medium 249 in the process direction P to a position adjacent the transfix roller 219 and then through the transfix nip 218 between the transfix roller 219 and the blanket 100. The transfix roller 219 may apply pressure against the back side of the print medium 249 in order to press the front side of the print medium 249 against the blanket 100 and the intermediate transfer member 212. Although the transfix roller 219 may also be heated, as shown, the transfix roller 219 is unheated in FIG. 2. The pre-heater assembly 252 for the print medium 249 may be in the media path leading to the transfix nip 218. The pre-conditioner assembly 252 may condition the print medium 249 to a predetermined temperature that aids in the transferring of the image to the media, thus simplifying the design of the transfix roller 219. The pressure produced by the transfix roller 219 on the back side of the heated print medium 249 may facilitate the transfixing (transfer and fusing) of the image from the intermediate transfer member 212 onto the print medium 249. The rotation or rolling of both the intermediate transfer member 212 and transfix roller 219 not only transfixes the images onto the print medium 249, but also assists in transporting the print medium 249 through the transfix nip 218. The intermediate transfer member 212 may continue to rotate to enable the printing process to be repeated.

After the intermediate transfer member moves through the transfix nip 218, the image receiving surface passes a cleaning unit that removes residual portions of the sacrificial polyurethane coating and small amounts of residual ink from the image receiving surface of the blanket 100. In the printer 200, the cleaning unit is embodied as a cleaning blade 295 that engages the surface of the blanket 100. The blade 295 is formed from a material that wipes the surface of the blanket 100 without causing damage to the blanket 100. For example, the cleaning blade 295 may be formed from a flexible polymer material in the printer 200. In another embodiment, the cleaning unit may include a roller or other member that applies a mixture of water and detergent to remove residual materials from the surface of the blanket 100 after the intermediate transfer member moves through the transfix nip 218. The term "detergent" or cleaning agent refers to any surfactant, solvent, or other chemical compound that is suitable for removing any sacrificial polyurethane coating and any residual ink from the image receiving surface of the blanket 100.

The following examples are presented for illustrative purposes and are not intended to limit the scope of the disclosure.

Prophetic Example 1

An ELASTOSIL® RT 622 silicone (manufactured by Wacker Chemie AG) is used as the polymer matrix for the conformance layer 120. ELASTOSIL® RT 622 is a pourable two-component silicone rubber that vulcanizes at room temperature. Part A contains polydimethyl siloxane with silane (Si—H) functional groups while Part B contains polydimethyl siloxane containing terminal vinyl functional groups and a Pt catalyst, which is the curative agent for the silicone. The procedure for the incorporation of the reflective pigments 150 and curing the silicone elastomer is as follows.

The ELASTOSIL® RT 622 and 5.6 wt % HEUODUR® IR Black 940 (manufactured by Heucotech Ltd.) are combined with an appropriate amount of desired solvent (i.e., to yield the desired viscosity) and ball milling media, and the combination is milled for a 14-16 hour period. After milling, Part B is added slowly to stirring Part A at a 1:9 mass ratio. This gives a 5 wt % reflective pigment 150 loading in the final coating.

The activated formulation is coated on a blanket substrate 110 by flow coating, air dried, and post-cured at 150° C. for 4 hours to yield a blanket conformance layer 120 containing the reflective pigments 150 in a silicone matrix.

Prophetic Example 2

Figure 3:
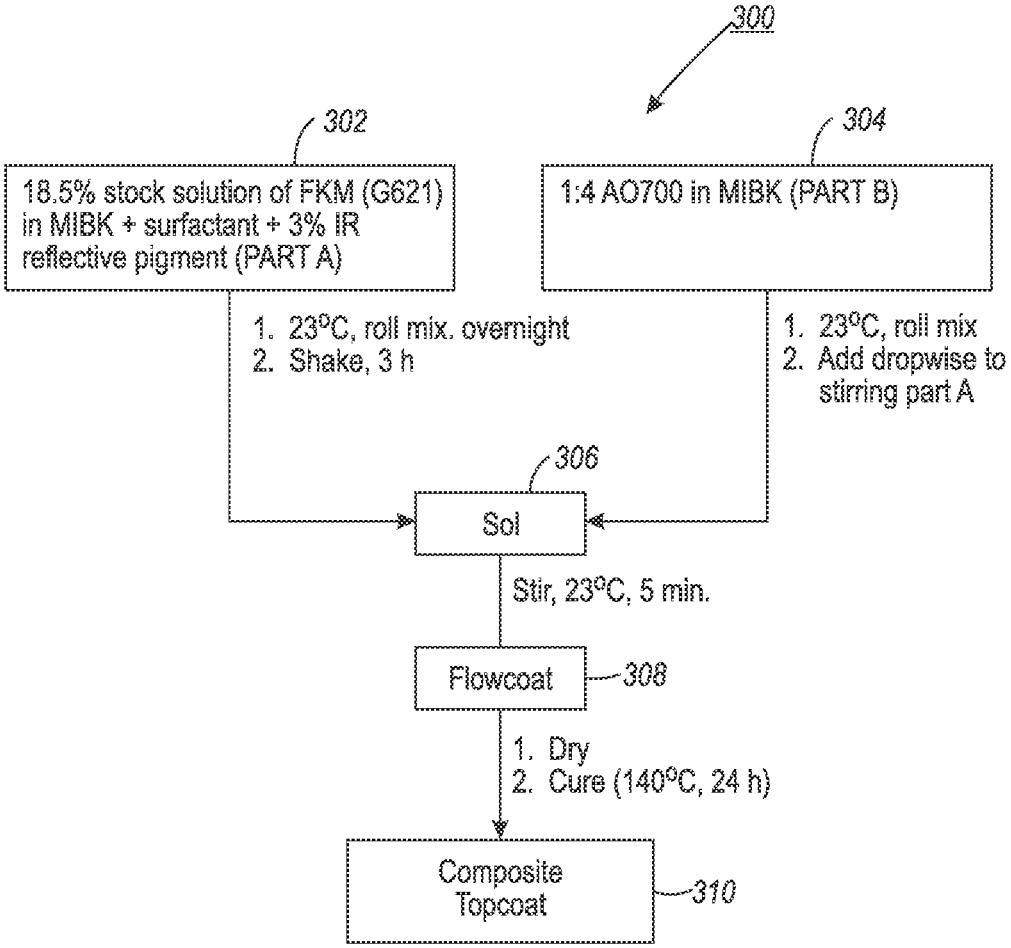
FIG. 3 depicts a schematic flowchart for forming an illustrative topcoat layer of a transfix blanket, according to one or more embodiments disclosed.

FIG. 3 depicts a schematic flowchart 300 for forming an illustrative topcoat layer 140 of a transfix blanket 100, according to one or more embodiments disclosed. More particularly, the flowchart 300 describes the formulation and flow coating of a fluoroelastomer-aminosilane graft with an infrared reflective pigment 150 (see FIG. 1) to yield a cured fluoroelastomer-infrared reflective pigment composite topcoat layer 140. The reflective pigment 150 may be or include HEUCODUR® IR Black 940 manufactured by Heucotech Ltd.

To form Part A, an 18.5 wt % solution of fluoroelastomer (e.g., G621 manufactured by Daikin Industries, Ltd.) is prepared by dissolving the G621 in methyl isobutyl ketone ("MIBK"), as shown at 302. Part A also includes low loading of surfactants. Part A is then mixed with 20 pph of HEUCODUR® IR Black 940 and shaken with a paint shaker in the presence of steel beads for at least three hours.

Part B includes a separate solution of amino crosslinker (N-(-2-aminoethyl)-3-aminopropyltrimethoxysilane, A0700) in MIBK prepared at a ratio of 1:4 by mass, as shown at 304. Part B is combined with Part A drop-wise while stirring, as shown at 306. Once the combination of Parts A and B is complete, the resulting solution is used for flow coating on a blanket substrate, as shown at 308. The fluoroelastomer composite coated substrate is dried and then cured at 140° C. for 24 hours to form the topcoat layer 140, as shown at 310.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" may include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter may take on negative values. In this case, the example value of range stated as "less than 10" may assume negative values, e.g. −1, −2, −3, −10, −20, −30, etc.

While the present teachings have been illustrated with respect to one or more implementations, alterations and/or modifications may be made to the illustrated examples without departing from the spirit and scope of the appended claims. For example, it may be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It may be appreciated that structural components and/or processing stages may be added, or existing structural components and/or processing stages may be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items may be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, the terms "exemplary" or "illustrative" indicate the description is used as an example, rather than implying that it is an ideal. Other embodiments of the present teachings may be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A transfix blanket for a printer, comprising:

a substrate layer comprising a first material selected from the group consisting of polyimide, aluminum, and woven fabric;

a conformance layer disposed at least partially on the substrate layer, wherein the conformance layer comprises a second material selected from the group consisting of silicone, a cross-linked silane, silica, alumina, iron oxide, and carbon black, and wherein the conformance layer further comprises a third material selected from the group consisting of titanium dioxide, nickel rutile, chromium rutile, cobalt-based spinel, chromium oxide, and chrome iron nickel black spinel;

an adhesive layer disposed at least partially on the conformance layer after the conformance layer is disposed on the substrate layer, wherein the adhesive layer comprises a fourth material that is different from the second material and the third material, and wherein the fourth material is selected from the group consisting of silane, epoxy silane, amino silane, silicone, and a cross-linked silane; and a topcoat layer disposed at least partially on the adhesive layer, wherein the topcoat comprises a fifth material selected from the group consisting of carbon black, graphene, carbon nanotubes, and iron oxide.

2. The transfix blanket of claim 1, wherein the third material is present in the conformance layer in an amount from 0.1 wt % to 20 wt %.

3. The transfix blanket of claim 1, wherein the third material is also present in the adhesive layer in an amount from 0.1 wt % to 20 wt %.

4. The transfix blanket of claim 1, wherein the third material is disposed in both the conformance layer and the adhesive layer.

5. The transfix blanket of claim 1, wherein a thickness of the conformance layer is from 500 μm to 7000 μm, wherein a thickness of the adhesive layer is from 0.05 μm to 10 μm, and wherein a thickness of the topcoat layer is from 5 μm to 100 μm.

6. The transfix blanket of claim 1, wherein the silica, alumina, iron oxide, or carbon black is present in the conformance layer in an amount from 0.1 wt % to 20 wt %.

7. The transfix blanket of claim 1, wherein the third material comprises particles, and wherein the particles have an average cross-sectional length from 0.1 micrometers to 10 micrometers.

8. The transfix blanket of claim 1, wherein the topcoat layer also comprises a sixth material selected from the group consisting of silicone, a cross-linked silane, a fluoroelastomer, and a fluoroplastic.

9. A transfix blanket for a printer, comprising:

a substrate layer comprising a first material selected from the group consisting of polyimide, aluminum, and woven fabric;

a conformance layer disposed at least partially on the substrate layer, wherein the conformance layer comprises a second material selected from the group consisting of silicone, a cross-linked silane, silica, alumina, iron oxide, and carbon black;

an adhesive layer disposed at least partially on the conformance layer after the conformance layer is disposed on the substrate layer, wherein the adhesive layer comprises a third material that is different from the second material, and wherein the third material is selected from the group consisting of silane, epoxy silane, amino silane, silicone, and a cross-linked silane; and a topcoat layer disposed at least partially on the adhesive layer, wherein the topcoat layer comprises a fourth material selected from the group consisting of titanium dioxide, nickel rutile, chromium rutile, cobalt-based spinel, chromium oxide, and chrome iron nickel black spinel, and wherein the topcoat layer comprises a fifth material selected from the group consisting of carbon black, graphene, carbon nanotubes, and iron oxide.

10. The transfix blanket of claim 9, wherein the fourth material is present in the topcoat layer in an amount from 0.1 wt % to 20 wt %.

11. The transfix blanket of claim 9, wherein a thickness of the conformance layer is from 500 μm to 7000 μm, wherein a thickness of the adhesive layer is from 0.05 μm to 10 μm, and wherein a thickness of the topcoat layer is from 5 μm to 100 μm.

12. The transfix blanket of claim 9, wherein the fourth material comprises particles having an average cross-sectional length from 0.1 micrometers to 10 micrometers.

13. The transfix blanket of claim 9, wherein the topcoat layer also comprises a sixth material selected from the group consisting of silicone, a cross-linked silane, a fluoroelastomer, and a fluoroplastic.

14. A method for operating a printer, comprising:

jetting aqueous ink onto a transfix blanket, wherein the transfix blanket comprises:

a substrate layer comprising a first material selected from the group consisting of polyimide, aluminum, and woven fabric;

a conformance layer disposed at least partially on the substrate layer, wherein the conformance layer comprises a second material selected from the group consisting of silicone, a cross-linked silane, silica, alumina, iron oxide, and carbon black;

an adhesive layer disposed at least partially on the conformance layer after the conformance layer is disposed on the substrate layer, wherein the adhesive layer comprises a third material that is different from the second material, and wherein the third material is selected from the group consisting of silane, epoxy silane, amino silane, silicone, and a cross-linked silane; and a topcoat layer disposed at least partially on the adhesive layer, wherein the topcoat layer comprises a fourth material selected from the group consisting of titanium dioxide, nickel rutile, chromium rutile, cobalt-based spinel, chromium oxide, and chrome iron nickel black spinel, and wherein the topcoat layer comprises a fifth material selected from the croup consisting of carbon black, graphene, carbon nanotubes, and iron oxide; and heating the aqueous ink on the transfix blanket.

15. The method of claim 14, wherein heating the ink comprises applying radiant energy to the ink.

16. The method of claim 15, wherein the fourth material reflects a portion of the radiant energy that has passed through the topcoat layer back into the topcoat layer.

17. The method of claim 14, further comprising forming the topcoat layer on the transfix blanket by flow coating a fluoroelastomer-aminosilane graft with the fourth material to produce a cured fluoroelastomer.

18. The method of claim 14, further comprising forming the topcoat layer on the transfix blanket by:

dissolving a fluoroelastomer in methyl isobutyl ketone to form a first product;

mixing the first product with chromium iron oxide to form a second product;

mixing an amino crosslinker with methyl isobutyl ketone to form a third product; and mixing the second product and the third product to form a fourth product.

19. The method of claim 18, further comprising:

flow coating the fourth product onto the at least a portion of the transfix blanket; and heating the fourth product to form the topcoat layer.

20. The method of claim 19, wherein the fourth product is heated for twenty four hours at 140° C.

* * * * *